US007837134B2

(12) United States Patent
Akisada et al.

(10) Patent No.: US 7,837,134 B2
(45) Date of Patent: Nov. 23, 2010

(54) ELECTROSTATICALLY ATOMIZING DEVICE

(75) Inventors: Shousuke Akisada, Hikone (JP); Sumio Wada, Hikone (JP); Toshihisa Hirai, Hikone (JP); Kishiko Hirai, legal representative, Hikone (JP); Mikio Itou, Hikone (JP); Kyohei Kada, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 257 days.

(21) Appl. No.: 12/095,464

(22) PCT Filed: Dec. 18, 2006

(86) PCT No.: PCT/JP2006/325178

§ 371 (c)(1),
(2), (4) Date: May 29, 2008

(87) PCT Pub. No.: WO2007/072776

PCT Pub. Date: Jun. 28, 2007

(65) Prior Publication Data

US 2009/0272827 A1 Nov. 5, 2009

(30) Foreign Application Priority Data

Dec. 19, 2005 (JP) ..... 2005-365573

(51) Int. Cl.

| | |
|---|---|
| ***B05B 5/025*** | (2006.01) |
| ***B05B 5/00*** | (2006.01) |
| ***B03C 3/00*** | (2006.01) |
| ***B03C 3/16*** | (2006.01) |
| ***F25D 21/00*** | (2006.01) |

(52) U.S. Cl. ..... 239/690; 96/27; 96/53; 62/150

(58) Field of Classification Search ..... 239/3, 239/289, 690, 696, 697, 704, 706, 707; 96/27, 96/52, 53, 83; 62/150
See application file for complete search history.

(56) References Cited

U.S. PATENT DOCUMENTS 6,182,453 B1 * 2/2001 Forsberg ..... 62/125

(Continued)

FOREIGN PATENT DOCUMENTS

EP 0 893 128 A2 1/1999

(Continued)

OTHER PUBLICATIONS

Supplementary European Search Report for the Application No. EP 06 84 2861 dated Dec. 18, 2009.

(Continued)

*Primary Examiner*—Darren W Gorman
(74) *Attorney, Agent, or Firm*—Cheng Law Group, PLLC

(57) ABSTRACT

An emitter electrode is cooled by a cooler to generate condensed water which is charged by a high voltage applied between the emitter electrode and an opposed electrode and is discharged as a mist of charged minute water particles. A controller is provided to vary a temperature drop to a predetermined minimum temperature in dependence of an environmental temperature detected by a temperature sensor. The temperature drop is made variable in proportion to the environmental temperature. Accordingly, a sufficient amount of water can be condensed on the emitter electrode simply by controlling the cooling of the emitter electrode without relying upon an environmental humidity.

8 Claims, 5 Drawing Sheets

U.S. PATENT DOCUMENTS

| | | | | |
|---|---|---|---|---|
| 6,471,753 | B1 * | 10/2002 | Ahn et al. | 96/27 |
| 2006/0131449 | A1 * | 6/2006 | Azukizawa et al. | 239/690.1 |
| 2008/0130189 | A1 | 6/2008 | Kobayashi et al. | |
| 2009/0001200 | A1 | 1/2009 | Imahori et al. | |

FOREIGN PATENT DOCUMENTS

| | | | |
|---|---|---|---|
| JP | 04-205872 | A | 7/1992 |
| JP | 11-009671 | A | 1/1999 |
| JP | 2003-079714 | A | 3/2003 |
| JP | 2003-287316 | A | 10/2003 |
| JP | 2005-131549 | A | 5/2005 |
| WO | WO-2005/097338 | A1 | 10/2005 |
| WO | WO-2005/097339 | A1 | 10/2005 |

OTHER PUBLICATIONS

International Search Report for the Application No. PCT/JP2006/325178 mailed Mar. 27, 2007.

* cited by examiner

ELECTROSTATICALLY ATOMIZING DEVICE

TECHNICAL FIELD

The present invention is directed to an electrostatically atomizing device which generates a mist of charged minute water particles.

BACKGROUND ART

Japanese Patent Publication No. 2005-131549 discloses an electrostatically atomizing device which is designed to electrostatically atomize water for generation of a mist of charged minute water particles. The device is contemplated to induce Rayleigh disintegration of the water for atomizing the same into the mist of charged minute water particles of nanometer sizes. The charged minute water particles thus obtained contain radicals and remain over a long period of time so as to be diffused into a space in a large amount, thereby being allowed to react effectively with offensive odors adhered to a room wall, clothing, or curtains to deodorize the same.

The device has an emitter electrode which is cooled to condense water from within surrounding air for atomizing the condensed water by electric discharge. In this instance, a cooling control is required to supply the water stably on the emitter electrode. The condensation of water does not occur unless the emitter electrode is cooled below a dew point temperature, and water will freeze upon being overcooled, both disabling the atomization. Further, stable atomization is not expected in excess or less amount of the condensed water. Therefore, it is desired to settle the above problem.

In view of that the dew point temperature is determined by an environmental temperature and humidity, it is best to measure both the temperature and humidity and make a feedback control based upon these parameters for determining a cooling temperature of the emitter electrode. However, such scheme necessitates the use of a humidity sensor and a temperature sensor, and moreover a one-chip microcomputer, for example, which realizes a rather complicated circuitry of processing the environmental temperature and humidity in order to obtain an accurate dew point temperature, with an associated cost increase.

In a situation where the electrostatically atomizing device is incorporated into such an appliance that requires a successive atomizing operation over a long time, it is required to supply the condensed water continuously in a suitable amount as an excessive amount of the condensed water would certainly impede the atomization. However, when the electrostatically atomization device is incorporated into an appliance which operates only for a short time, a primary concern is to generate the condensed water rapidly, in view of that even if the condensed water should be excessively generated, the appliance would complete its intended operation before the excessively generated water would impede the electrical discharging. Accordingly, there is no need in such situation to determine the accurate dew point temperature based upon the environmental temperature and humidity.

DISCLOSURE OF THE INVENTION

In view of the above problem, the present invention has been achieved to provide an electrostatically atomizing device which is capable of rapidly starting an electrostatic atomization, yet at a low fabrication cost.

An electrostatically atomizing device in accordance with the present invention includes an emitter electrode, an opposed electrode opposed to the emitter electrode, a cooler configured to cool the emitter electrode for condensing water from within an atmosphere, and a high voltage source configured to apply a high voltage between the emitter electrode and the opposed electrode to charge the water condensed on the emitter electrode, thereby discharging a mist of charged minute water particles from a tip of the emitter electrode. The device further includes a temperature sensor for detection of an environmental temperature, and a controller which controls the cooler in such a manner as to vary a temperature drop of the emitter electrode towards a predetermined minimum temperature. The controller is configured to control the cooler independently of an environmental humidity. Thus, the temperature drop is caused to vary depending upon the environmental temperature, which enables to control the cooling of the emitter electrode without referring to the environmental humidity, yet assuring to condense a sufficient amount of water on the emitter electrode. Accordingly, the electrostatically atomizing device is free from a humidity sensor and an associated complicate circuitry so as to be fabricated at a low cost, yet efficient for short-time use.

Preferably, the cooler comprises the Peltier element so that the temperature drop of the emitter electrode is determined by a voltage applied to the Peltier element. In this instance, a predetermined relation between the temperature drop and the voltage is relied upon to apply the voltage corresponding to the environmental temperature in order to cool the emitter electrode to a suitable temperature for generation of the condensed water. A thermistor may be utilized as the temperature sensor to generate a voltage which is applied to the Peltier element and varies in proportion to the environmental temperature, thus simplifying a control circuitry.

The minimum temperature is set to be a temperature at which no freezing of water occurs, for example, −2° C., such that a control is made to cool the emitter electrode with reference to a predetermined relation between the temperature drop to the minimum temperature and the environmental temperature. Thus, the emitter electrode is free from freezing and is supplied efficiently with the condensed water.

It is preferred that the detected environmental temperature is corrected based upon a predetermined temperature error between the temperature of said emitter electrode and the environmental temperature. Thus, when the temperature sensor for the environmental temperature is located remote from the emitter electrode, the detected environmental temperature can be corrected to a temperature adjacent to the emitter electrode for cooling the emitter electrode to an optimum temperature.

In addition, the electrostatically atomizing device of the present invention may include a blower means for blowing the electrostatically atomized mist. Although the cooler is exposed to the air blow generated by the blower means so as to vary its cooling efficiency and bring about a varying cooling temperature of the emitter electrode, the controller can regulate the temperature drop, i.e., the voltage applied to the Peltier element in accordance with a flow rate of the air blow, enabling to cool the emitter electrode to the predetermined minimum temperature for assuring stable electrostatic atomization.

Further, the electrostatically atomizing device of the present invention is preferred to include a discharge current detection means configured to detect a discharge current flowing between the emitter electrode and the opposed electrode, and a freeze judge means configured to judge water freezing based upon the detected discharge current. In this version, the controller is configured to stop cooling the emitter electrode upon receiving a freeze signal indicative of the water freezing from the freeze judge means. Thus, the device can be restored to a water supplying mode after the occurrence of the freezing.

Still further, the controller may be configured to vary the temperature drop by the cooler in accordance with the discharge current detected by the discharge current detection means. Since the discharge current varies depending upon the amount of the water generated on the emitter electrode, the correction of the temperature drop based upon the discharge current enables to keep supplying a necessary amount of water on the emitter electrode.

BEST MODE FOR CARRYING OUT THE INVENTION

Figure 1:
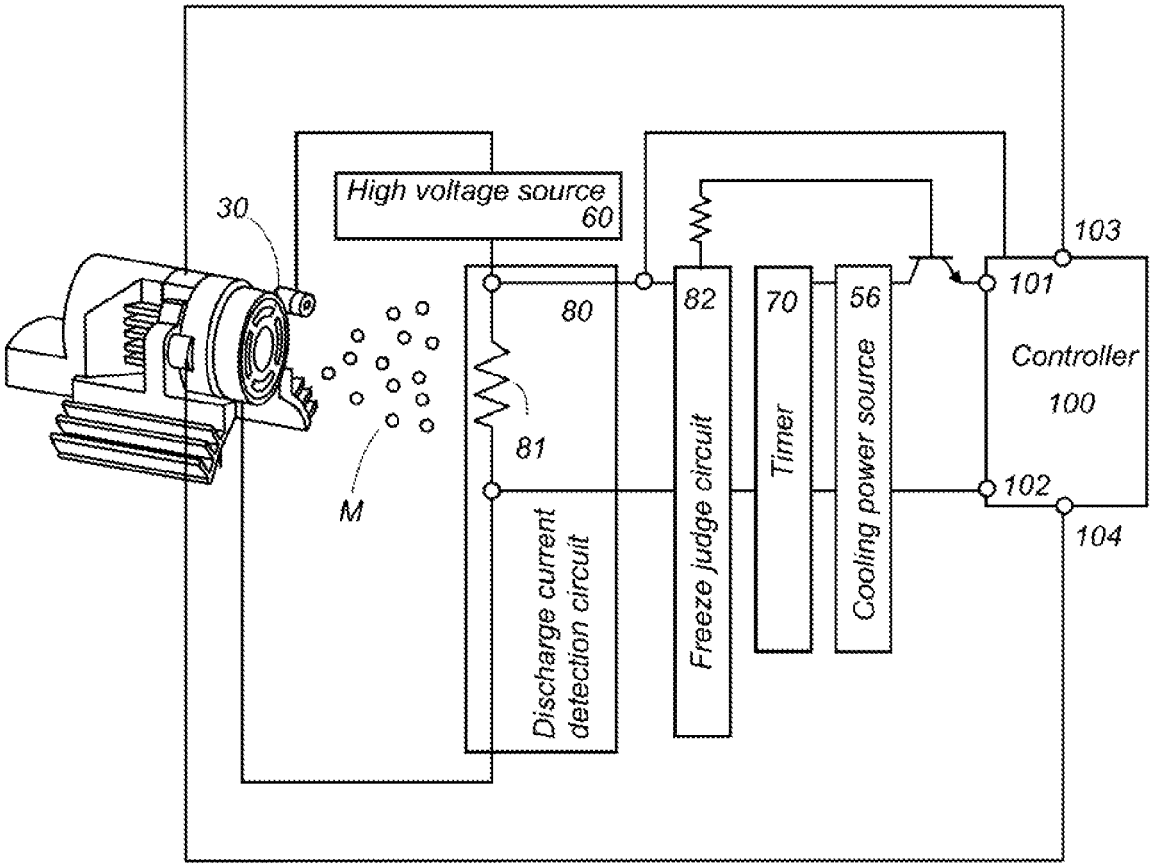
FIG. 1 is a schematic view of an electrostatically atomizing device in accordance with an embodiment of the present invention.
Figure 2:
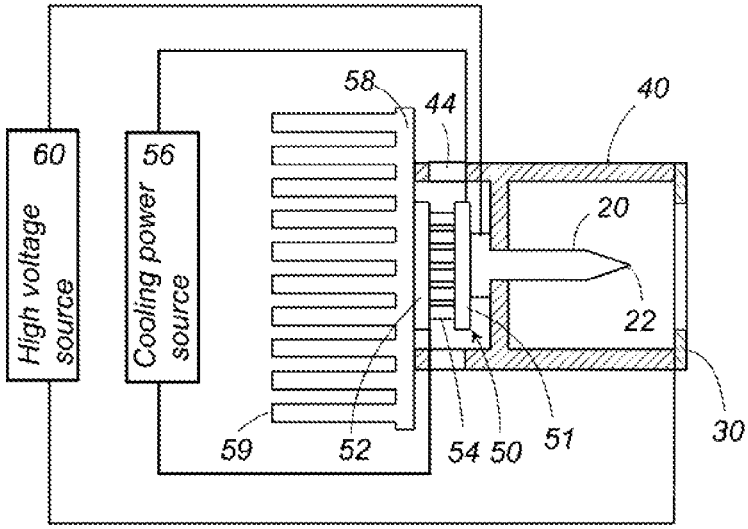
FIG. 2 is a sectional view of the above device.

Referring now to FIGS. 1 and 2, an explanation is made to an electrostatically atomizing device in accordance with one embodiment of the present invention. As shown in FIG. 2, the electrostatically atomizing device has a spray barrel 40 carrying an emitter electrode 20, an opposed electrode 30, and a cooler 50. The emitter electrode 20 is disposed on a center axis of the spray barrel 40 to have its rear end secured to an upper part of the cooler 50 with its front end projecting in the spray barrel 40. The opposed electrode 30 is ring-shaped to have a center circular opening and is secured to a front end of the spray barrel 40 in an axially spaced relation along the axis of the barrel 40 from a discharge end at the front end of the emitter electrode 20. The emitter electrode 20 and the opposed electrode 30 are connected to an external high voltage source 60. The high voltage source 60 includes a transformer and is configured to apply a predetermined high voltage between the emitter electrode 20 and the grounded opposed electrode 30. The high voltage (for example, −5.5 kV) is given to the emitter electrode 20 so as to develop a high voltage electric field between the discharge end at the front end of the emitter electrode 20 and an inner periphery of the opposed electrode 30, thereby electrostatically charging water supplied onto the emitter electrode 20 as will be discussed later, thereby discharging a mist M of charged minute water particles from the discharge end 22.

The high voltage applied between the emitter electrode 20 and the opposed electrode 30 develops a Coulomb force between the water at the front end of the emitter electrode 20 and the opposed electrode 30, which causes the water surface to bulge locally, thereby forming a Taylor cone. Then, electric charges become concentrated at a tip of the Taylor cone to increase the electric field intensity and therefore the Coulomb force, thereby further developing the Taylor cone. Upon the Coulomb force exceeding the surface tension of the water, the Taylor cone is caused to disintegrate repeatedly (Rayleigh disintegration) to generate a large amount of the mist including charged minute water particles of nanometer sizes. The mist goes toward the opposed electrodes 30 and is discharged out of the spray barrel 40, as being carried on an air flow caused by an ionic wind directed towards the opposed electrode 30 from the emitter electrode 20. A plural of air inlets 44 are disposed in the peripheral wall of the atomizing barrel 40 to introduce an air to keep generating the air flow.

Mounted on the bottom of the spray barrel 40 is a cooler 50 composed of a Peltier-effect thermoelectric module having a cooling side which is coupled to the emitter electrode 20 to cool the emitter electrode 20 below a dew point temperature of water for condensing the moisture in the ambient air on the emitter electrode. In this sense, the cooler 50 itself defines a water feed means which supplies the water onto the emitter electrode 20. The cooler 50 is composed of a plurality of the Peltier effect elements 54 connected in series between a pair of electrically conductive circuit plates 51 and 52, and is configured to cool the emitter electrode 20 at a cooling rate determined by a variable voltage given from an external cooling power source 56. One of the conductive circuit plates at the cooling side is thermally coupled to the rear end of the emitter electrode 20, while the other conductive circuit plate on the heat radiator side is thermally coupled to a heat radiating plate 58. The radiating plate 58 is fixed to the rear end of the spray barrel 40 and is provided with heat radiating fins 59.

The electrostatically atomizing device includes a controller 100 which controls the cooling of the emitter electrode 20 by the cooler 50 in order to keep the emitter electrode 20 at a suitable temperature, i.e., a temperature at which a sufficient amount of water is condensed on the emitter electrode.

In addition to the controller 100, the electrostatically atomizing device includes a timer 70, a discharge current detection circuit 80, and a freeze judge circuit 82. The timer 70 is provided to set a time of cooling the emitter electrode 20, and to deenergize the cooler 50 after an elapse of a predetermined cooling time. The cooling time by the cooler 50 is set to be a time expected to generate the condensed water continuously in a suitable amount on the emitter electrode, and may be set to give an intermittent cooling. When the timed operation is not necessary, the timer 70 is turned off to disable its operation. The discharge current detection circuit 80 is provided to detect a discharge current flowing between the emitter electrode 20 and the opposed electrode 30. The discharge current is measured based upon a voltage across a resistor 81 inserted between the emitter electrode 20 and the opposed electrode. The measured value of the discharge current is input to the controller 100 as indicative of the amount of water supplied onto the emitter electrode 20. The freeze judge circuit 82 provides a freeze signal when the measured value of the discharge current is judged to indicate the freezing, interrupting the power from the cooling power source 56 to the cooler 50. Upon disappearance of the freeze signal, the cooler 50 is controlled to resume its operation.

Figure 4:
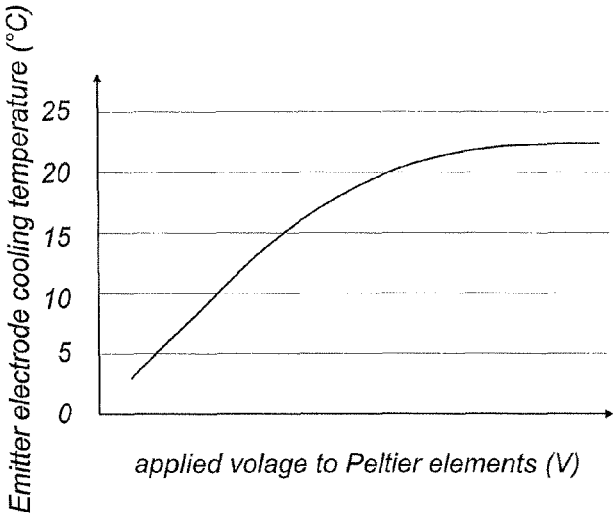
FIG. 4 is a graph explaining a basic concept of operating the above device.

Prior to discussing details of the controller 100, FIGS. 4 to 7 are referred first for explaining a relation between the environmental temperature and the applied voltage that has to be applied to the Peltier elements in order to condense the water on the emitter electrode at the environmental temperature. As shown in FIG. 4, in order to cool the emitter electrode 20 to a temperature below the dew point, it is required to increase the applied voltage to the Peltier elements with a rise of the environmental temperature for increasing the temperature drop down to the dew point.

Figure 5:
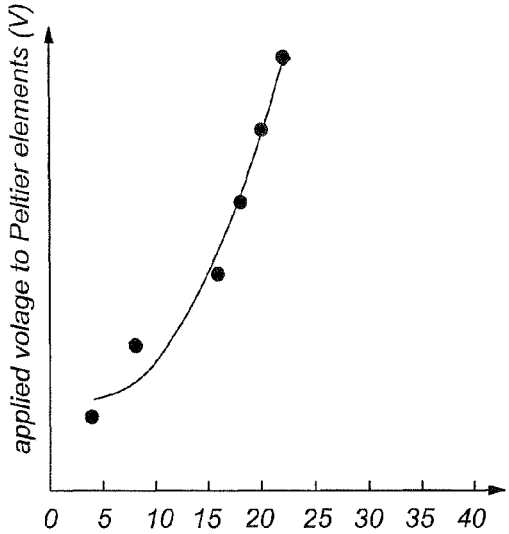
FIG. 5 is a graph explaining a basic concept of operating the above device.

Generally, at the environmental temperature of 20° C., the dew point temperature settles at 20° C. with the environmental humidity (relative humidity) of 100%, and at 0° C. with the environmental humidity of about 25%. However, the electrostatically atomizing device of the present invention is designed to generate the condensed water as rapidly as possible without causing the water freezing for short-time use. For this purpose, a maximum temperature drop is given irrespective of the environmental humidity at any environmental temperature in order to cool the emitter electrode to the minimum temperature that does not cause freezing. In view of that the electrostatically atomizing device is limited for a short-time use, the minimum temperature is set to be −2° C. Thus, the temperature drop of 22° C. is given to the emitter electrode at the environmental temperature of 20° C. FIG. 5 illustrates an approximation curve showing a relation between the applied voltage and the temperature drop based upon plotting of the voltages applied to the Peltier elements to obtain the temperature drop to the minimum temperature from individual environmental temperatures. The approximation curve is realized in the circuit of FIG. 3 by a voltage output from a circuit composed of the thermistor 92 utilized as the temperature sensor and resistors 94, 95, and 96 selectively connecting the thermistor 92 in series with a constant voltage source V1. The thermistor 92 exhibits a negative temperature coefficient to lower its resistance with the temperature increase, and increase the applied voltage to the Peltier element along the curve of FIG. 5 so as to give a large temperature drop with the rise of the environmental temperature.

Figure 6:
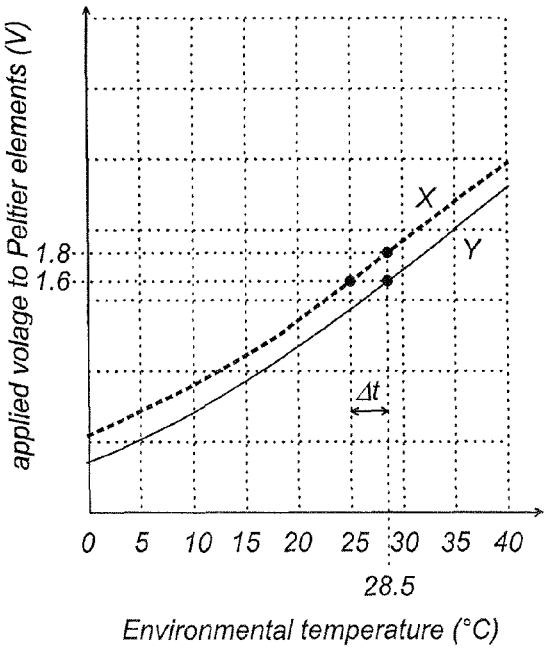
FIG. 6 is a graph explaining a basic concept of operating the above device.

Since the thermistor 92 is located adjacent to electronic components constituting the controller 100 but remote from the emitter electrode 20, the environmental temperature detected by the thermistor 92 is expected to be somewhat higher than the environmental temperature adjacent the emitter electrode exposed to the surrounding space. Such temperature difference (Δt) is predictable. For example, when the difference is assumed to be 3.5° C. in average, regulation is made for the thermistor 92 and resistors 94 and 95 to correct a temperature-voltage curve (X) with the temperature difference (Δt) in order to obtain a corrected temperature-voltage curve (Y), as shown in FIG. 6. With this correction, an optimum voltage (=1.6 V) is applied to the emitter electrode 20 when the thermistor 92 detects a temperature of 28.5° C. at a surrounding temperature of 25° C. for the emitter electrode 20. That is, the emitter electrode 20 is prevented from being applied with a voltage (=1.8 V) corresponding to the detected temperature of 28.5° C. by the thermistor 92, and therefore from being cooled to a temperature blow the minimum temperature, thereby avoiding generation of excessive amount of the condensed water or freezing thereof.

Figure 7:
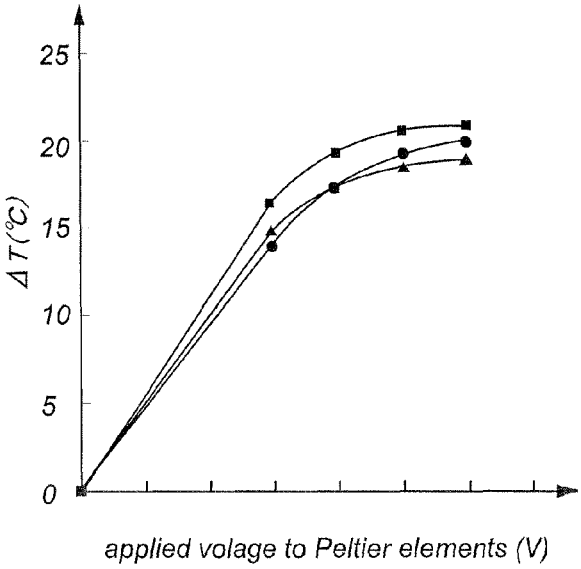
FIG. 7 is a graph explaining a basic concept of operating the above device.

Further, the electrostatically atomizing device of the present invention is preferred to include a cooling fan for generating an air flow cooling the heat radiating fins, or to make the use of an air flow generated in an appliance such as an air purifier or hair dryer into which the device is incorporated, for cooling the heat radiating fins. In this instance, flow rate or temperature of the air flow would vary a cooling effect of the heat radiating fins with accompanying variation in the heat radiating effect of the emitter electrode 20 by the cooler 50. That is, even when the cooler 50 receives the applied voltage determined by the environmental temperature, the emitter electrode 20 may be cooled to a temperature above or below the minimum temperature, which may cause excessive or insufficient generation of the condensed water. For instance, when the electrostatically atomizing device is incorporated in the hair dryer to have different situations of using mild cool air, mild hot air, and strong hot air selectively as the air flow, there are seen, as shown in FIG. 7, different curves indicating a relation between the applied voltage (V) to the Peltier elements and the temperature drop (DT=environmental temperature−electrode temperature) down to the predetermined minimum temperature, as shown in FIG. 7, in which ¦ designates the curve for the mild cool air, ● designates the curve for the mild hot air, and ▲ designates the curve for the strong hot air.

Figure 3:
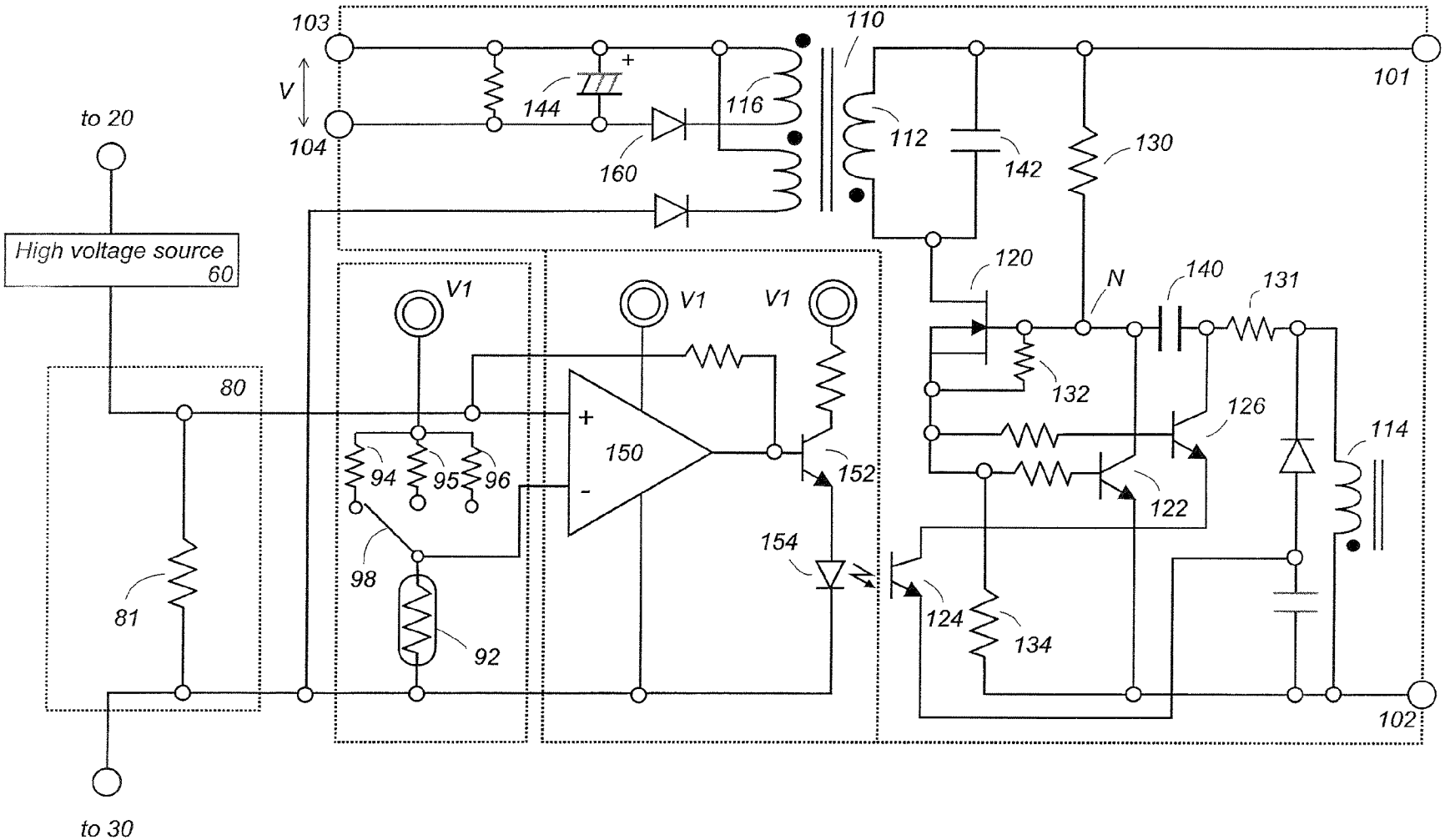
FIG. 3 is a circuit diagram of the above device.

In consideration of the above problem, the electrostatically atomizing device of the present invention is preferred to have an arrangement of correcting the curve of FIG. 6 for cooling the emitter electrode 20 to the minimum temperature. The correction is realized, as seen in FIG. 3, by a switch 98 configured to selectively connect one of resistors 94, 95, and 96 of different resistances between the thermistor 92 and the constant voltage source V1. The switch is interlocked with a switch for selection of the flow rate and temperature of the air flow so as to cool the emitter electrode 20 always to the predetermined minimum temperature without being influenced by the variance of the flow rate and the temperature.

An operation of the controller 100 is now explained with reference to FIG. 3. The controller 100 is configured to generate, based upon a driving voltage given across input terminals 101 and 102, the voltage (V) applied to the Peltier elements across output terminals 103 and 104, and includes a transformer 110, switching elements (FET) 120, and 122, resistors 130, 131, 132, and 134, and capacitors 140, 142, and 144. The transformer 110 includes coils 112, 114, and 116.

Firstly, an explanation is made to a basic operation of the controller 100. Upon the driving voltage being applied across the input terminals 101 and 102, a current flows through resistor 130, capacitor 140, resistor 131, and coil 114 to start charging capacitor 140, while a current flow through resistors 130, 132, and 134. As capacitor 140 is charged to develop across resistor 132 a voltage that exceeds a threshold of a gate voltage of FET 120, FET 120 is turned on to flow a current through coil 112, FET 120, and resistor 134. Subsequently, when the voltage across resistor 134 increased to exceed a threshold of a base voltage of the switching element (transistor) 122, transistor 122 is turned on to lower a voltage across resistor 132 and turn off FET 120. At this time, a current flows in a parallel circuit of coil 112 and capacitor 142, thereby developing an induced voltage at coil 114. The induced voltage is applied to a node N connected to gate of FET 120. When the induced voltage becomes maximum, FET 120 is again turned on, which turns on transistor 122, and turn off FET 120. While FET 120 repeats turning on and off in this manner, a voltage induced at coil 116 of transformer 110 is rectified by diode 160 and smoothed by smoothing capacitor 144 to provide the smoothed DC voltage (V) which is applied through output terminals 103 and 104 to the Peltier elements of the cooler 50.

The applied voltage (V) is determined by a duty ratio of FET 120 which is controlled to turn on and off based upon the voltage appearing across the thermistor 92 in proportion to the environmental temperature, and a discharge current flowing between the emitter electrode 20 and the opposed electrode 30. For this purpose, the controller 100 includes a comparator 150 which receives the voltage across the thermistor 92 at its inverting terminal (−), and receives at its non-inverting terminal (+) a voltage across current detection resistor 81 for detection of the discharge current. The output of comparator 150 is connected to a base of transistor 152. When the discharge current increases to give a voltage which exceeds a reference voltage determined by the voltage across the thermistor 92, transistor 152 becomes conductive to turn on LED 154. LED 154 is photo-coupled to a photo-transistor 124 so as to turn it on upon LED 154 being turned on. In this consequence, a current flowing through resistor 130 is drawn through transistor 126 to thereby turn off FET 120. That is, when the condensed water is generated excessively on the emitter electrode 20, the discharge current becomes greater than a predetermined level to thereby shorten a time of turning off FET 120 and lower the duty of FET 120, thus lowering the applied voltage (V) given across output terminals 103 and 104. When the applied voltage (V) is lowered, the amount of the condensed water on the emitter electrode is reduced to make the discharge current smaller than the predetermined level, which in turn increase the duty of FET 120 and raise the applied voltage (V) for expediting the generation of the condensed water. By repeating the above operations, the cooling of the emitter electrode is controlled to continuously supply a constant amount of the condensed water on the emitter electrode for stably keeping the electrostatically atomization.

Since the reference voltage of comparator 150 is set to be the voltage appearing across the thermistor 92 in proportion to the environmental temperature, the control is kept to cool the emitter electrode based upon the temperature drop determined by the environmental temperature, so long as the discharge current is lower than the predetermined level, i.e., the condensed water is being generated in a constant amount on the emitter electrode, thereby keeping the constant amount of the condensed water on the emitter electrode. Further, since the voltage across the thermistor 92 is corrected by means of the switch selected in accordance with the flow rate and temperature of the air generated by the fan incorporated in or available by the electrostatically atomizing device, the emitter electrode can be cooled with the optimum temperature drop depending upon an operating circumstance.

Although not shown in FIG. 3, the discharge current detection circuit 80 has its output sent to the freeze judge circuit 82 which judges, upon seeing no discharge current, the occurrence of the water freezing on the emitter electrode to issue a cooling stop signal, thereby interrupting the input voltage to the controller 100 from the cooling power source 50 for temporarily stopping the cooling of the emitter electrode. Upon seeing the discharge current, the controller 100 resumes its control for cooling the emitter electrode by the temperature drop in accordance with the environmental temperature. The cooling stop signal may be utilized to temporarily stop the high voltage source 60.

Figure 8:
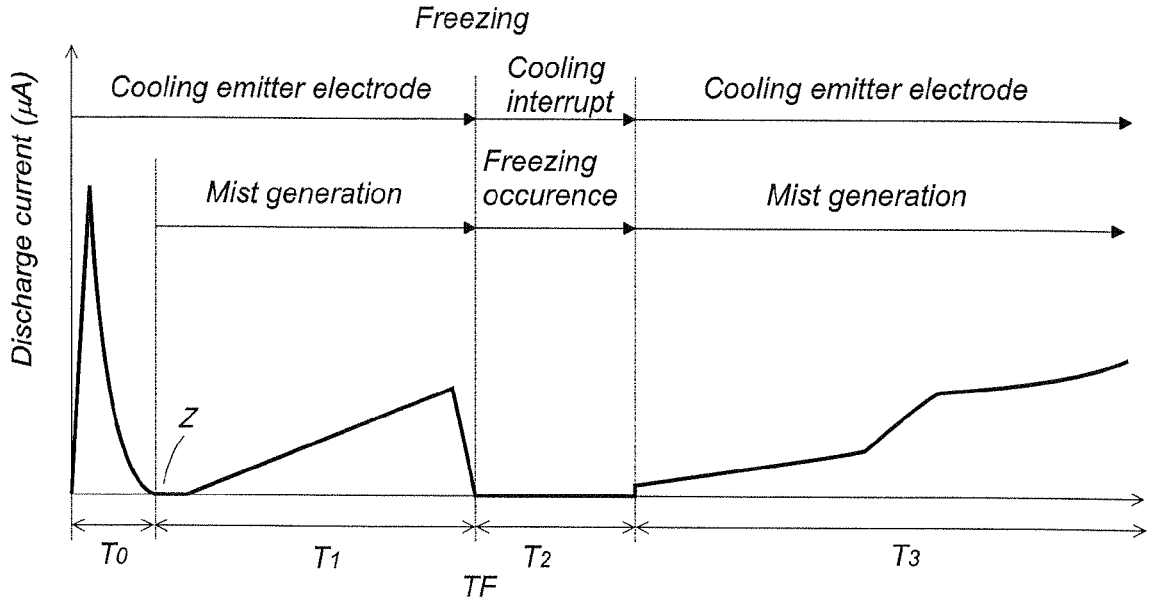
FIG. 8 is a graph explaining an operation of the above device in terms of a discharge current.
Figure 9:
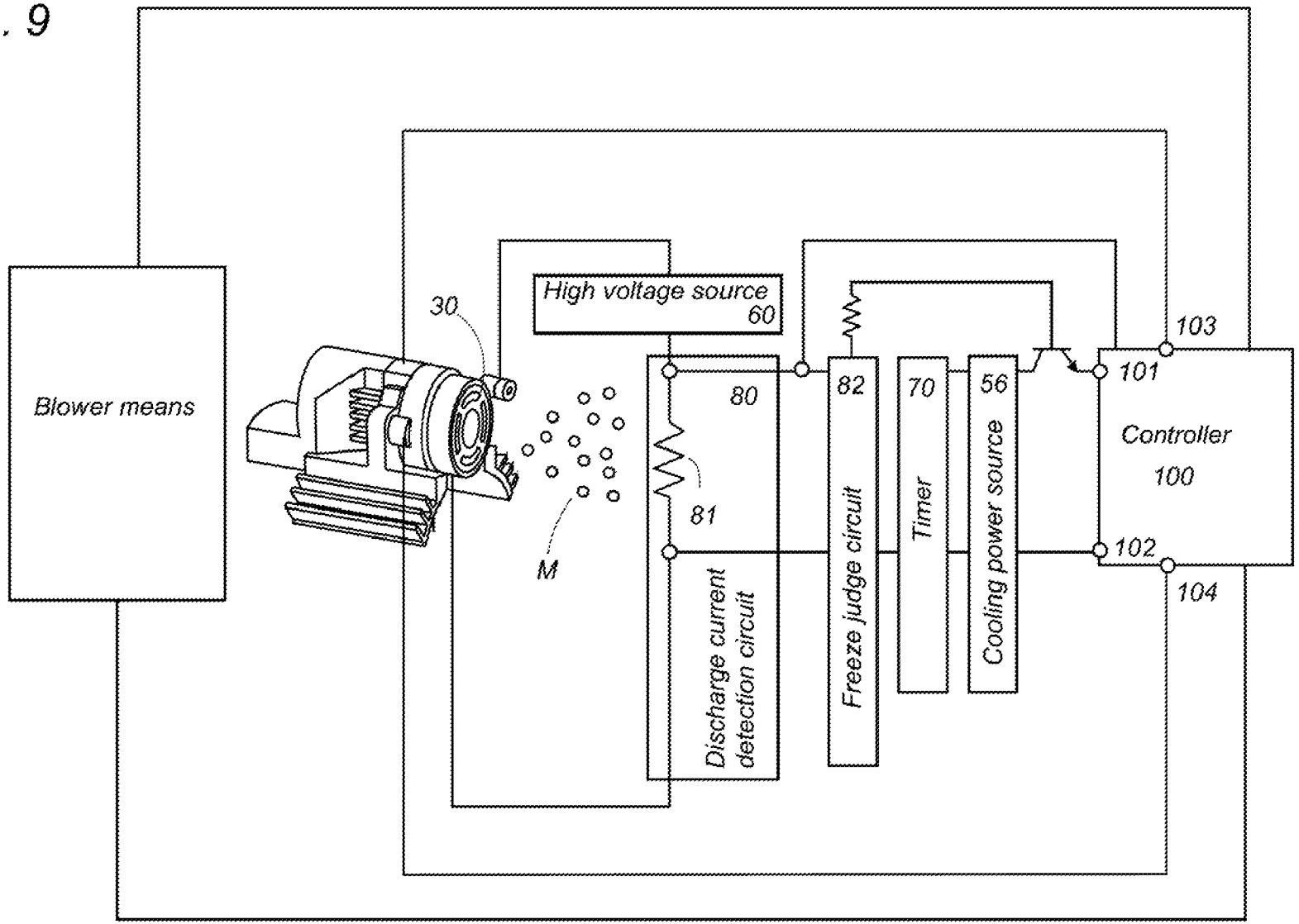
FIG. 9 is a schematic view of an electrostatically atomizing device in accordance with another embodiment of the present invention.

FIG. 8 illustrates the operation of the electrostatically atomizing device in relation to the discharge current in a situation where the water freezing occurs. During an initial period TO immediately after the start of the operation, no condensation water is supplied on the emitter electrode such that an electrical discharge develops between the emitter electrode and the opposed electrode by the high voltage applied therebetween, generating negative ions with resulting increase of the discharge current. Subsequently, the discharge current will decrease as the condensation of water begins, and then increase with the accumulation of the condensed water for stably and continuously generating the mist of the charged minute water particles (time period T1). When the water freezing occurs at time TF, the discharge current becomes zero to interrupt the cooling until an elapse of a time period (T2). After the elapse of the time period, the cooling is resumed to increase the discharge current with the accumulation of the condensed water so as to keep generating the mist for a subsequent time period (T3). In this manner, as the discharge current exceeds the predetermined level, the applied voltage to the Peltier elements is controlled to lower for lessening the cooling rate and enabling to keep generating the mist stably with the adequate amount of the condensed water.

Since the initial time period T0 is provided to preliminary give a sufficient amount of the condensed water on the emitter electrode 20 and is predicable, it is made to disable the control of the cooling temperature based upon the discharge current during this time period. That is, the cooling of the emitter electrode can be controlled only based upon the environmental temperature detected by the voltage across the thermistor 92, while ignoring the output from the discharge current detection circuit 80. Alternatively, it is possible to acknowledge that the generation of the negative ions is terminated at time (Z) at which the discharge current begins to increase again after having decreased to zero, and to start the above control based upon the discharge current at that time. Further, in anticipation of that the discharge current might not be lowered to zero, it can be made to judge the termination of the negative ion generating period based upon a varying rate of the discharge current in order to start the above control based upon the discharge current upon the termination of the negative ion generation period. The output from the discharge current detection circuit 80 may be utilized to control the high voltage applied between the emitter electrode 20 and the opposed electrode 30. In this instance, the high voltage can be inhibited from being applied during the initial time period T0.

The invention claimed is:

1. An electrostatically atomizing device comprising:

an emitter electrode;

an opposed electrode opposed to said emitter electrode;

a cooler configured to cool said emitter electrode to condense thereon water from within an atmosphere;

a high voltage source configured to apply a high voltage between said emitter electrode and said opposed electrode to charge the water condensed on the emitter electrode, thereby discharging a mist of charged minute water particles from a tip of the emitter electrode;

a temperature sensor configured to detect an environmental temperature; and a controller configured to control said cooler in such a manner as to vary a temperature drop of the emitter electrode depending on the environmental temperature detected by the temperature sensor towards a predetermined minimum temperature, wherein said controller is configured to control said cooler independently of an environmental humidity.

2. An electrostatically atomizing device as set forth in claim 1, wherein said cooler comprises a Peltier element which determines said temperature drop in proportion to a voltage being applied, said controller being configured to apply the voltage to give the temperature drop in match with the ambient temperature.

3. An electrostatically atomizing device as set forth in claim 1, wherein said minimum temperature is set to be a temperature at which no freezing of water occurs.

4. An electrostatically atomizing device as set forth in claim 2, wherein said detected environmental temperature is corrected based upon a predetermined temperature error between the temperature of said emitter electrode and the environmental temperature.

5. An electrostatically atomizing device as set forth in claim 1, further including:

a blower means for blowing the electrostatically atomized mist, said controller being configured to vary the temperature drop by said cooler in accordance with blowing quantity of said blower means.

6. An electrostatically atomizing device as set forth in claim 1, further including:

a discharge current detection means configured to detect a discharge current flowing between said emitter electrode and said opposed electrode; and a freeze judge means configured to judge water freezing based upon the detected discharge current, said controller being configured to stop cooling said emitter electrode upon receiving a freeze signal indicative of the water freezing from said freeze judge means.

7. An electrostatically atomizing device as set forth in claim 1, further including:

a discharge current detection means configured to detect a discharge current flowing between said emitter electrode and said opposed electrode, said controller being configured to vary said temperature drop by said cooler in accordance with the detected discharge current.

8. An electrostatically atomizing device as set forth in claim 2, wherein said minimum temperature is set to be a temperature at which no freezing of water occurs.

* * * * *